US005950456A

United States Patent [19]

Kirsch, Jr.

[11] Patent Number: 5,950,456

[45] Date of Patent: Sep. 14, 1999

[54] ARTICLE OF JEWELRY WITH PIVOTAL GEM

[76] Inventor: James Robert Kirsch, Jr., 13345 Purple Sage, Dallas, Tex. 75240

[21] Appl. No.: 08/934,723

[22] Filed: Sep. 22, 1997

[51] Int. Cl.[6] ..... A44C 17/02

[52] U.S. Cl. ..... 63/31; 63/15

[58] Field of Search ..... 63/15, 31

[56] References Cited

U.S. PATENT DOCUMENTS

| | | | |
|---|---|---|---|
| 645,909 | 3/1900 | Boismaure . | |
| 922,212 | 5/1909 | Tropin . | |
| 1,712,783 | 5/1929 | Alpern | 63/15 |
| 2,666,305 | 1/1954 | Wittmayer | 63/15 |
| 2,835,117 | 5/1958 | Lutrario | 63/27 |
| 3,081,997 | 3/1963 | Glass et al. | 63/15 X |
| 4,187,697 | 2/1980 | Castelo | 63/31 |
| 4,220,017 | 9/1980 | Freeman | 63/15 |
| 4,294,084 | 10/1981 | Lampert | 63/15 |
| 4,726,200 | 2/1988 | Carter | 63/15 |
| 4,764,140 | 8/1988 | Wood | 63/15 X |
| 4,970,878 | 11/1990 | Lee | 63/31 X |
| 5,275,019 | 1/1994 | Pagani | 63/15 |
| 5,353,608 | 10/1994 | Berkowitz | 63/1.1 |
| 5,787,731 | 8/1998 | Ebara | 63/29.1 |

FOREIGN PATENT DOCUMENTS

| | | | |
|---|---|---|---|
| 2376637 | 9/1978 | France | 63/31 |

*Primary Examiner*—Brian K. Green
*Assistant Examiner*—Andrea Chop
*Attorney, Agent, or Firm*—Jenkens & Gilchrist, A Professional Corporation

[57] ABSTRACT

An article of jewelry in the form of a ring incorporating a pivotal mounting for a gem mounted therein. The pivotal mounting facilitates the placement of the gem in a setting which is pivotally connected to oppositely disposed, cantilevered weights depending therefrom. The weights are positioned outwardly of a gem mounting yoke and depend therefrom for imparting movement thereto in response to motions of the hand of the wearer. In this manner, the pivotally mounted gem is more predominantly displayed and creates an aesthetically pleasing image.

10 Claims, 3 Drawing Sheets

ARTICLE OF JEWELRY WITH PIVOTAL GEM

BACKGROUND OF THE INVENTION

1. Field of the Invention

The present invention relates to articles of jewelry and, more particularly, but not by way of limitation, to a ring having a pivotally mounted gem setting.

2. History of Related Art

Jewelry manufacture is an ancient art which today combines both old and new technology, craftsmanship and creativity. In early days, the coining of precious metals into decorative pendants and rings became a commercial trade in and of itself. Innovations in metallurgy, as well as gem cutting resulted in continuing changes in jewelry design. Most particularly, the design of jewelry has changed dramatically in recent centuries with the advent of precise machining techniques, advanced tooling capabilities and precision design innovations. Such technological and artistic achievements have resulted in dynamic changes to ring and pendant designs. Not the least of the dynamic changes has been the capability of mounting gems and precious stones in settings allowing gems to move therein.

The prior art is replete with design innovations addressing gem settings and ornamental figurations therefor, including movement associated therewith. For example, U.S. Pat. No. 645,909 issued in 1900 for an innovative jewelry mounting configuration. This innovation addressed means by which the precious metal could be vibratorily supported to increase brilliance, luster and attractiveness of the jewelry. U.S. Pat. No. 922,212 issued in 1909 for yet a different jewelry mounting technique wherein a gem could be mounted for pivotal movement in a ring or the like. In one position, the jewel setting is exposed to view while in another, pivotal position, the jewel set is hidden from view so that practically all those exposed to view will be the base and a portion of the body. In this particular position, the article appears to the ordinary observer as one in which no jewel is contained. These early twentieth century innovations may also be compared to later twentieth century jewelry designs.

More conventional jewelry designs have also addressed mounting configurations facilitating movable gems. U.S. Pat. No. 4,294,084, for example, issued in 1981 for an article of jewelry with a reciprocally movable gem. The article of jewelry shown therein comprises a finger ring having a mounting for a gem which enables the gem to be freely reciprocally movable. The movement occurs concurrently with movement of the wearer's finger so as to achieve eye catching esthetic affects and unexpected enhancement of reflection of light. Moreover, U.S. Pat. No. 4,220,017 issued in 1980 for a convertible finger ring wherein the gem mount may be rotated relative to the ring band to provide either a pendant or a ring configuration. The designs for multi-use jewelry pieces also include U.S. Pat. No. 5,353,608, which issued in 1994. A combination ring pendant is also shown in U.S. Pat. No. 4,726,200, which issued in 1988 to Carter. The Carter patent teaches a convertible ring pendant comprising an ornamental piece of jewelry configured in one of two configurations depending on the owner's needs.

As referenced above, the commercial market for jewelry is facing constant innovation which challenges both craftsmanship and creativity. To date, various jewelry configurations must meet multiple purposes and fulfill a variety of design criteria. The idea of a ring containing a gem that pivots easily under the movement of the hands of the user would therefore, be a marked advance over the prior art and an innovation which could produce aesthetically pleasing configurations.

The present invention overcomes the problems of the prior art by providing a ring assembly incorporating a pivotal gem setting which is adapted for relative ease in pivoting in response to movement of the hand of the wearer. The ring configuration of the present invention is provided in an aesthetically pleasing assembly that may be reliably worn and economically fabricated.

SUMMARY OF INVENTION

The present invention relates to an article of jewelry incorporating a pivotal gem setting. More particularly, the present invention addresses an improved jewelry mounting of a type including a shank with a yoke having oppositely disposed generally upstanding portions adapted for pivotally mounting a gem setting. The setting is configured for supporting a jewel in any one of a plurality of easily pivoted positions. The invention comprises the utilization of at least one weight secured to the gem setting and positioned to impart pivotal actuation thereto in response to movement of the jewelry mounting.

In another aspect, the present invention relates to the assembly of an article of jewelry incorporating a pivotal gem setting. More particularly, the present invention addresses a method of pivotally mounting a gem within a yoke having oppositely disposed generally upstanding portions. The setting is configured for supporting the jewel in any one of a plurality of easily pivoted positions. The invention comprises the step of mounting at least one weight to the gem setting in position to impart pivotal actuation thereto in response to movement of the jewelry mounting.

BRIEF DESCRIPTION OF THE DRAWINGS

A more complete understanding of the method and apparatus of the present invention may be had by reference to the following Detailed Description when taken in conjunction with the accompanying Drawings wherein.

DETAILED DESCRIPTION

Figure 1:
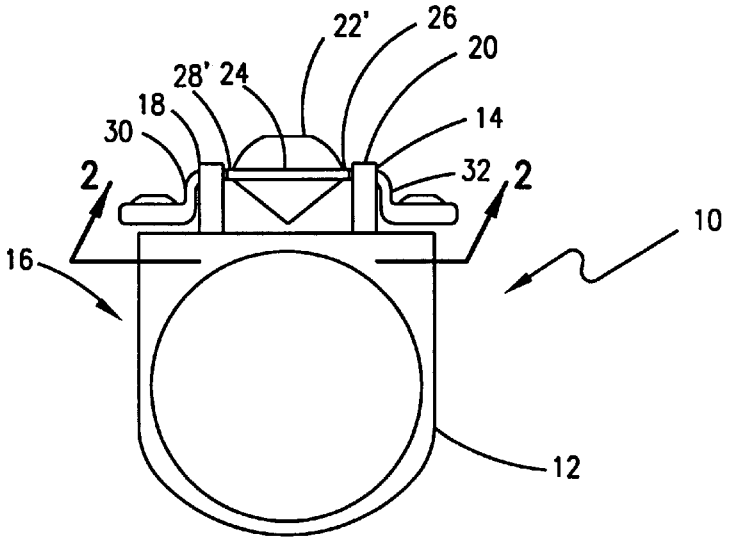
FIG. 1 is a front elevational view of the ring of the present invention illustrating the pivotal mounting of a precious gem therein.

Referring first to FIG. 1 there is shown a perspective view of the ring 10 constructed in accordance with the principles of the present invention. The ring 10 is constructed with a shank 12 having a yoke 14 upstanding from the upper region 16 thereof. The yoke is constructed with first and second upstanding members 18 and 20 which comprise a pivotal base for mounting a gem 22 there between. The gem 22 is mounted within a bezel 24, and the bezel 24 is mounted to a pair of outwardly extending shafts 26 and 28. The shaft 28 extends through the first upstanding yoke member 18, while the second shaft 26 extends through the second upstanding yoke member 20. A first arm 30 depends downwardly from shaft 28 outwardly of yoke member 18, while a second arm 32 depends downwardly from shaft 26 outwardly of second upstanding yoke member 20. The arms 30 and 32 provide cantilevered weights relative to the bezel 24 for facilitating pivotal action of the gem 22 in response to movement of the hand of the wearer.

Figure 2:
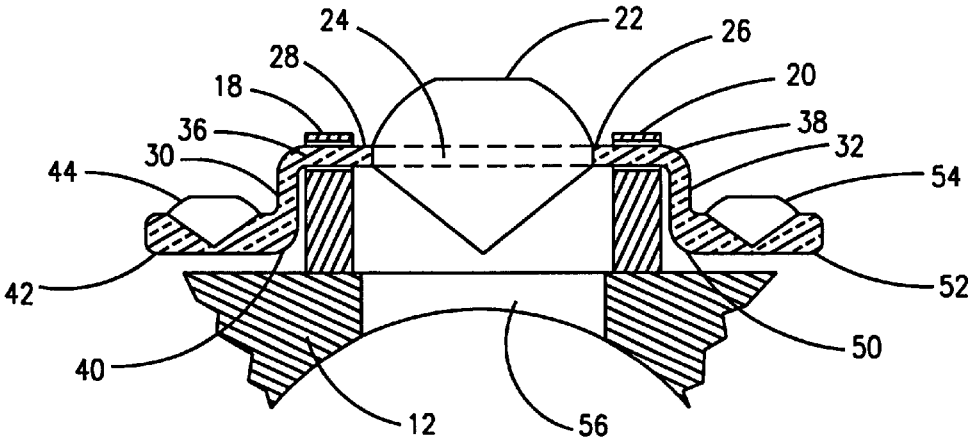
FIG. 2 is an enlarged, fragmentary, cross-sectional view of a portion of the ring of FIG. 1 illustrating the assembly thereof.

Referring now to FIG. 2, there is shown an enlarged side elevational cross-sectional view of an upper portion of the ring 10 of FIG. 1, illustrating the assembly thereof. In this particular view, it may be seen that the shafts 26 and 28 are positioned for extending from the bezel 24 through the upstanding yoke members 18 and 20, respectively. In that regard, first upstanding yoke member 18 is constructed with an aperture 36 formed in an upper region thereof, while second upstanding yoke member 20 is formed with an aperture 38, also formed in upper region thereof. The apertures 36 and 38 are sized to receive the shafts 28 and 26, respectively, therethrough in low friction rotational engagement therewith. The depending arm members 30 and 32 may be attached to the shafts 28 and 26 in a variety of ways, although in the present embodiment arms 30 and 32 are welded to shafts 28 and 26, respectively, for depending therefrom in a secure, cantilevered relationship. The lower end 40 of arm 30 is constructed with a bezel 42 containing a gem 44 therein. Likewise, the lower region 50 of arm 32 is constructed with a bezel 52 for containing a gem 54 therein. Gems 44 and 54 further provide weight to the arms 30 and 32, respectively, for further facilitating the pivotal actuation of the gem 22 mounted between upstanding yoke members 18 and 20 of the shank 12. An aperture 56 is provided immediately beneath the gem 22 for purposes of providing clearance during the rotation of said gem between said yoke members.

Figure 3A:
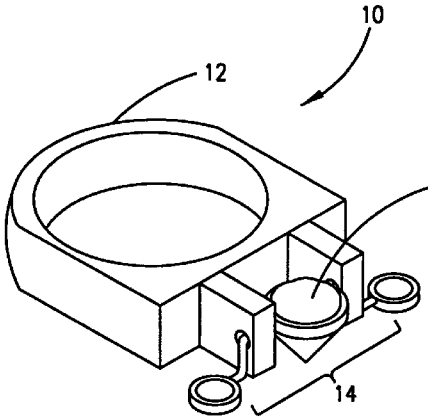
FIGS. 3A, 3B, 3C are perspective views of the ring of FIG. 1 in three different positions.
Figure 3B:
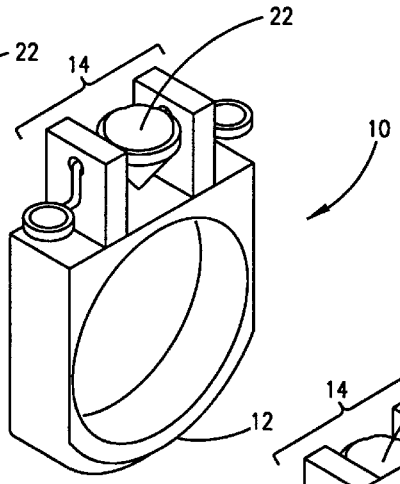
Figure 3C:
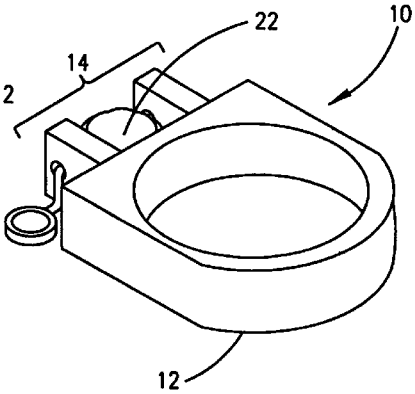

Referring now to FIG. 3A, 3B and 3C, there are shown three views of the ring 10 of FIG. 1, illustrating various positions thereof causing rotation of the gem 22 therein. In FIG. 3A, the gem 22 is in an upright position even though the shank 12 lies horizontal. In FIG. 3B, the ring is shown rotated into a vertical position relative to its position in FIG. 3A. The gem 22 still assumes the same upright angle.

Referring now to FIG. 3C, it may be seen that the shank 12 has been rotated into a second generally horizontal position. In this position, the gem 22 still has maintained an upright position, as in FIGS. 3A and 3B, further illustrating the pivotal actuation of said gem 22 in said yoke 14.

Figures 4A, 4B, 4C:
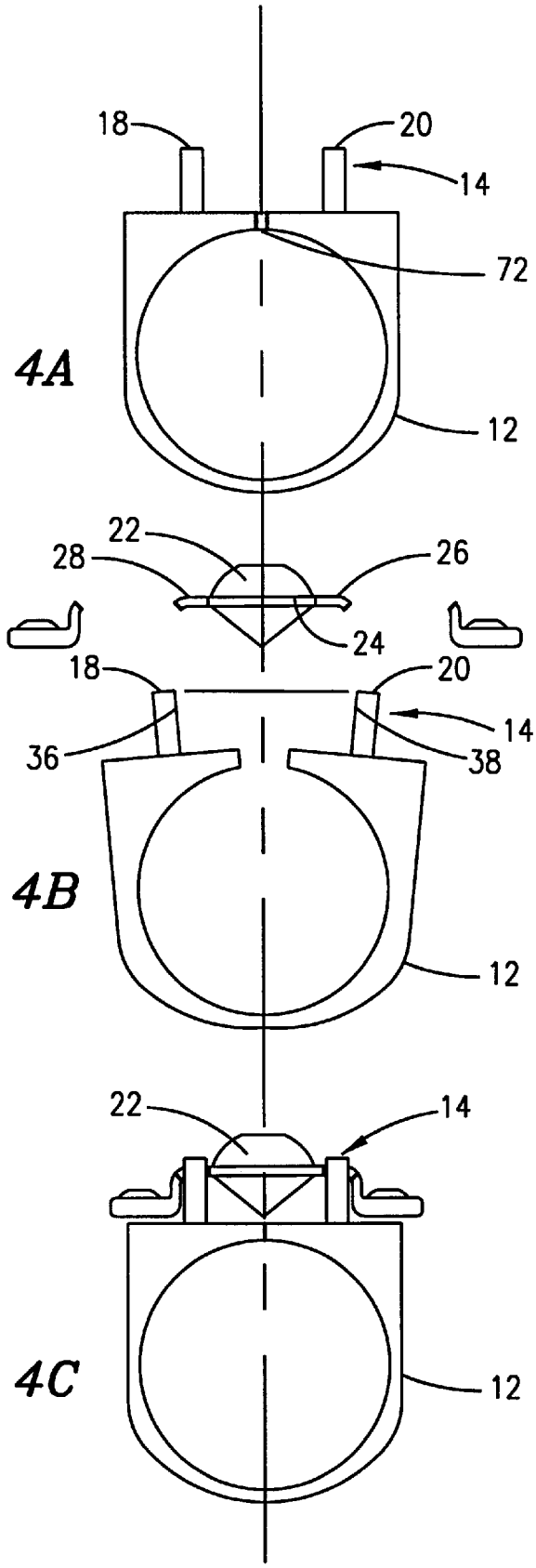
FIGS. 4A, 4B, 4C are front elevational views of the ring of FIG. 1 illustrating one method of assembly thereof.

Referring now to FIG. 4A, 4B and 4C, there is shown one method of assembling the ring 10 of the present invention. In FIG. 4A, the shank 12 is shown to be presented without a gem secured therein. In this particular configuration, it may be seen that it would be difficult to install a bezel and the outwardly extending shafts 28 and 26 as shown in FIG. 4 into the yoke 14. In order to provide such an assembly without cutting the upstanding yoke members 18 and 20, the shank is cut in region 70 forming the base of the yoke 14. A cut line 72 is therein shown, which cut line may be provided through a saw blade, laser or the like. Various forms of cutting are conventionally utilized in the jewelry business.

Referring now to FIG. 4B, the cut shank 12 of FIG. 4A is shown expanded into position for receipt of the assembled bezel 24 and shafts 28 and 26 extending outwardly therefrom. The shafts 28 and 26 are aligned with the apertures 36 and 38 for insertion therein. Once said shafts have been inserted into said apertures, the shank 12 is in a position for closure. FIG. 4C shows said closure with said shafts and bezel pivotally secured within the yoke 14. In this position, the cut line 72 of shank 12 is bonded by welding or the like. Once bonded, the shank 12 is then polished and otherwise processed to create an aesthetically pleasing appearance.

It is thus believed that the operation and construction of the present invention will be apparent from the foregoing description. While the method and apparatus shown or described has been characterized as being preferred it will be obvious that various changes and modifications may be made therein without departing from the spirit and scope of the invention as defined in the following claims.

What is claimed is:

1. In a jewelry mounting including a shank having oppositely disposed generally upstanding yoke portions having apertures therethrough adapted for pivotally mounting a first bezel containing a jewel therein the improvement comprising:

two outwardly extending shafts extending from a first bezel each said shaft extending through a corresponding aperture in a corresponding upstanding yoke portion a weight portion, secured to one of said two outwardly extending shafts, said weight positioned outwardly of said corresponding upstanding yoke portion to impart pivotal movement to the bezel in response to movement of the jewelry mounting.

2. The jewelry mounting improvement as set forth in claim 1 wherein said jewerly mounting comprises a ring.

3. The jewelry mounting improvement as set forth in claim 1 wherein said weight secured to said one of said two outwardly extending shafts extends downwardly therefrom.

4. The jewelry mounting improvement as set forth in claim 3 wherein said weight is an ornamental element of the jewelry mounting.

5. The jewelry mounting improvement as set forth in claim 4 wherein said ornamental element is another bezel for mounting a gem.

6. The jewelry mounting improvement as set forth in claim 1 further including a second weight secured to the other of said two outwardly extending shafts and disposed outwardly of its corresponding upstanding yoke potion.

7. The jewelry mounting improvement as set forth in claim 6 wherein said weight secured to one of said two outwardly extending shafts and said weight secured to the other of said two outwardly extending shafts each include a bezel for mounting gems complementing a jewel contained in the first bezel.

8. A jewelry mounting for displaying a gem, said jewelry mounting comprising;

a shank;

a yoke having oppositely disposed arms upstanding from said shank, each of said oppositely disposed arms having an aperture therethrough;

a bezel positioned between said oppositely disposed arms and including means for mounting said gem therein;

a pair of oppositely disposed shafts extending outwardly from said bezel, each said shaft passing through a corresponding said aperture in said oppositely disposed arms to provide a pivotal mounting of said bezel; and at least one weight secured to one of said oppositely disposed shafts and depending downwardly therefrom, outwardly of said yoke, for imparting pivotal movement to said bezel in response to movement of the jewelry mounting.

9. The jewelry mounting as set forth in claim 8 wherein said jewelry mounting is a ring.

10. The jewelry mounting as set forth in claim 8 and further including a second weight secured to the other of said oppositely disposed shafts and disposed outwardly of said yoke.

* * * * *